US010799948B2

(12) United States Patent
Wang et al.

(10) Patent No.: US 10,799,948 B2
(45) Date of Patent: Oct. 13, 2020

(54) METHOD AND APPARATUS FOR CASTING A MATERIAL COMPRISING OF NANO-MICRO DUPLEX GRAIN STRUCTURE

(71) Applicant: University of Science and Technology Beijing, Beijing (CN)

(72) Inventors: Zidong Wang, Beijing (CN); Tao Wang, Beijing (CN); Xiaohua Chen, Beijing (CN)

( * ) Notice: Subject to any disclaimer, the term of this patent is extended or adjusted under 35 U.S.C. 154(b) by 0 days.

(21) Appl. No.: 16/278,736

(22) Filed: Feb. 19, 2019

(65) Prior Publication Data

US 2019/0176230 A1 Jun. 13, 2019

Related U.S. Application Data

(63) Continuation of application No. PCT/CN2016/111355, filed on Dec. 21, 2016.

(30) Foreign Application Priority Data

Aug. 19, 2016 (CN) ..... 2016 1 0696626

(51) Int. Cl.

| | |
|---|---|
| ***B22D 27/08*** | (2006.01) |
| ***B22D 27/04*** | (2006.01) |
| ***B22D 13/02*** | (2006.01) |
| *B22D 21/00* | (2006.01) |

(52) U.S. Cl.

CPC ..... *B22D 27/08* (2013.01); *B22D 13/023* (2013.01); *B22D 27/045* (2013.01); *B22D 21/007* (2013.01)

(58) Field of Classification Search

CPC ..... B22D 13/00; B22D 13/02; B22D 13/023; B22D 21/007; B22D 27/04; B22D 27/045; B22D 27/08

USPC ..... 164/114, 118, 286, 289

See application file for complete search history.

(56) References Cited

U.S. PATENT DOCUMENTS 2,037,618 A 4/1936 Carpenter
2,961,703 A 11/1960 Pinotti
4,280,551 A * 7/1981 Ohara et al. ..... B22D 13/063 141/34

(Continued)

FOREIGN PATENT DOCUMENTS

CN 101487108 A 7/2009
CN 102330612 A 1/2012

(Continued)

OTHER PUBLICATIONS

Internation Search Report of PCT/CN2016/111355, dated May 19, 2017.

*Primary Examiner* — Kevin P Kearns
(74) *Attorney, Agent, or Firm* — Erson IP (Nelson IP)

(57) ABSTRACT

A method and apparatus cast a material with nano-micro duplex grain structure. The apparatus includes module system, heating system casting mold and gating system, multiaxial compound motion system accompanied by the following technological characteristics; alloy smelting; after heat preservation, alloy melt is poured into the casting mold which is put into the centrifugal barrel of the six-axis motion system; then the casting mold carries out composite motion and the alloy melt starts solidification; as a result, casting Al—Si alloy block with multi-scale nano-structure includes nano-micro duplex grain group is prepared.

8 Claims, 4 Drawing Sheets

(56) References Cited

U.S. PATENT DOCUMENTS

| | | | |
|---|---|---|---|
| 5,826,322 | A | 10/1998 | Hugo et al. |
| 2007/0077319 | A1 | 4/2007 | Huang et al. |

FOREIGN PATENT DOCUMENTS

| | | | |
|---|---|---|---|
| CN | 102409188 | A | 4/2012 |
| CN | 103495720 | A | 1/2014 |
| CN | 203418111 | U | 2/2014 |
| CN | 104772451 | A | 7/2015 |
| CN | 105328169 | A | 2/2016 |
| CN | 106111950 | A | 11/2016 |
| CN | 205927083 | U | 2/2017 |

* cited by examiner

METHOD AND APPARATUS FOR CASTING A MATERIAL COMPRISING OF NANO-MICRO DUPLEX GRAIN STRUCTURE

CROSS-REFERENCE TO RELATED APPLICATIONS

This application is a continuation of International Patent Application No. PCT/CN2016/111355 with a filing date of Dec. 21, 2016, designating the United States, now pending, and further claims priority to Chinese Patent Application No. 201610696626.X with a filing date of Aug. 19, 2016. The content of the aforementioned applications, including any intervening amendments thereto, are incorporated herein by reference.

TECHNICAL FIELD

The present invention relates generally to the field of metal nano-structure casting, and more particularly, to a method and apparatus for directly casting a large-size nano-structure material with nano-micro duplex grain group after solidification of liquid metal, and to casted Al—Si alloys of large-size nano-structure comprising of nano-micro mixed grain prepared from the method or by the apparatus.

BACKGROUND OF THE PRESENT INVENTION

Al—Si is one of the most widely used alloys due to its excellent castability, wear resistance and corrosion resistance, however, due to the Al—Si alloy itself, such as a hypoeutectic Al—Si alloy, lamellar Si and columnar crystal structure α-Al are often present in the as-cast microstructure which is harmful for the performance of the hypoeutectic Al—Si alloy. Therefore, it is very important to obtain the elaboration of axial alpha refinement of eutectic Al and Si.

In order to improve the properties of hypoeutectic Al—Si alloys, various methods were used to refine α-Al and eutectic Si by adding A or Al—Ti—B or Nb—B to refine α-Al. Eutectic Si is refined by adding Na or Sr. The result is very well by adding both of them. However, unnecessary intermetallic compounds may be generated because of bringing other elements into the alloys by adding the inoculant and nucleating agent. At the same time, there is an evidence showing that mutual interference of refinement exists between Al—Ti—B and Sr. It is an effective method to refine the grains that metal liquid goes under perturbation during solidification, for example, Al—Si alloy with eutectic composition is dealt with ultrasonic vibration. After the processing, there is equiaxial and spheroidizing primary α-Al structure in hypoeutectic Al—Si alloy, which is refined from dozens to hundreds of microns. At the same time, the eutectic Si also got a certain degree of refinement. However, much bigger casting can't be treated by this method because of the limitations of the treatment with good effect area only in very close about the range of vibration source near a few centimeters. On the other hand, electromagnetic stirring is also an effective method to perturb the solidified liquid metal that can refine α-Al and obtain the equiaxed α-Al structure at the same time. Nevertheless, this method cannot effectively refine the size of eutectic Si, which limited the effect of intensity enhancement. Although there are various treatment methods for liquid Al—Si alloy, the mentioned methods can refine the grain size to tens of microns at most without nanometer grain.

At present, the common way to obtain the nanometer or submicron grain size of Al—Si alloy is the equal channel corner extrusion method (ECAP) with large deformation under solid state. Venkateswarlu obtained the size of α-Al grain with 0.7 μm and the size of Si grain with 1.08 μm by making the Al-2Si going through a channel with a diameter of 10 mm and a length 60 mm via this method. The size of α-Al grain-reached 653 nm via letting the Al-10Si go through a channel with a diameter of 20 mm and a length of 70 mm at the temperature of 200° C. by Cardoso with this method. Gutierrez-Urrutia gained the size of α-Al grain with 420 nm and the size of Si grain with 1.4 μm by making the Al-7 wt % Si going through a channel with a diameter of 20 mm and a length of 60 mm via this method. The ECAP method requires the casting to pass through a small equal channel angle like a circular cross-section channel with only a few tens of millimeters in diameter, which greatly limits the size and shape of the material so that the obtained nanometer grain size structure is limited in size and shape.

For hypoeutectic Al—Si alloys, a method is required that can be used to refine α-Al and eutectic Si to a large extent, while at the same time can be applicable to large size, complex shape castings and easy to implement. A traditional idea for refining the grain size of castings is to pursue a large cooling rate or introduce a large number of nucleating cores. In this way, more cores are formed in the liquid metal and then the increase of the number of cores puts on the number of grains, which limits the growth space of each grain hence to achieve the effect of refining grains. It is difficult to obtain large size castings with several hundred nanometer grain size in matrix.

According to the basic model in the evolution of the interface on the growing of the grains from the cores in liquid metal by Wang, during the process of growth of grains, a sag area would be formed in the center of the grain due to the shear flow and the comprehensive effect of anisotropic parameters, and the sag is easy to fuse broken under the effect of shear flow so that smaller grains generate, which is called refining the grain size.

SUMMARY OF PRESENT INVENTION

An apparatus for casting materials with nano-micro duplex grain group, comprising:

a cabin system, a smelting system, a pouring system, a casting mold, a rotating plate, a coupling shall I, a coupling shaft II, an intermediate coupling seat, a coupling shaft III, a coupling shaft IV, a bottom support seat, a six-axis motion system I, a six-axis motion system II, and a centrifugal barrel;

wherein the casting mold is settled in the centrifugal barrel; the centrifugal barrel is linked with the six-axis motion system I via the rotating plate and the coupling shaft I; the six-axis motion system I is linked with the six-axis motion system II via the coupling shaft II, the intermediate coupling seat and the coupling shaft III; the six-axis motion system II is fixed on the bottom support seat via the coupling shaft IV; six-axis motion primitive of each single six-axis motion system is corresponding to six motors under which the rotating plate moves respectively along six axis, that are vertical motions along three kinds directions including x-axis, y-axis and z-axis; R represents rotating motion of the rotating plate, M represents vertical motion perpendicular to the direction of the rotating plate, T represents inclinable motion of the rotating plate and θ represents inclinable angle of the rotating plate; the number of the set of six-axis motion system is up to the requirement.

All apparatus as above mentioned, wherein the rotating plate of the six-axis motion primitive rotates along the path whose parameters are in the following limitation: R=−180°~+180°, X=−2500 mm~+2500 mm, Y=−2500 mm~+2500 mm, Z=0~1000 mm, T=−80°~+80°, M=0 mm~1000 mm.

An apparatus as above mentioned, wherein the distance of the six-axis motion system I is R1=0~3000 mm and the distance of the six-axis motion system II is R2=0~3000 mm.

A method for casting materials with nano-micro duplex grain group prepared by the apparatus as above mentioned, comprising:

(1) preparing metal and alloy;

(2) putting the metal and alloy into the crucible of the melting system; placing the casting mold in the centrifugal bucket; filling the refractory insulation material around the casting mold;

(3) heating the metal and alloy in the crucible to a default temperature and keeping the temperature for a default time, and then pouring metal liquid into the preheated casting mold;

(4) driving the six-axis motion systems to force the centrifugal barrel to move according to the set path, and then cooling the metal liquid down.

A method as above mentioned, wherein during the process of pouring metal liquid into the preheated casting mold, the superheat degree is controlled according to components of the metal, and during the process of cooling the metal liquid down, the condenser depression is controlled according to components of the metal; strong composite shear flow is formed in the metal liquid with the motion of the casting mold that is put into the six-axis motion systems.

A method as above mentioned, wherein the applicable material of the metal are nickel, aluminum, iron, copper and titanium, or alloy of the nickel, aluminum, iron, copper and titanium thereof, or intermetallic compound of titanium aluminum, intermetallic compound of iron aluminum, intermetallic compound of nickel aluminum.

A method as above mentioned, wherein the processes of melting and casting are carried out in vacuum or non-vacuum.

A casting Al—Si alloy block with multi-scale nano-structure prepared via the method for casting materials with nano-micro duplex grain group as recited as above, comprising:

silicon of 2 wt %~12 wt %;

superheat degree from 50° C. to 100° C. during the process of casting;

condenser depression from 0.1° C. to 50° C. during the process of cooling;

strong composite shear flow formed in the metal liquid with the motion of the casting mold that is put into the six-axis motion systems;

grain of the size from 10 nm to 5000 nm in the aluminum matrix phase;

grain of the size from 10 nm to 10 μm in the eutectic silicon phase.

A method as above mentioned, wherein a large number of second-phase nano-silicon particles are distributed in the aluminum matrix phase and the sizes of nano-silicon particles are between 1 nm to 100 nm.

The advantages of the invention are as follows:

1. The preparation method is simple. New nano grains and micro grains can be prepared directly by casting using the metal of nickel, aluminum, iron, copper, titanium and alloys thereof without rolling or extrusion through this method. The number of the grains can be increased and the size of the grains can be limited while the matrix of the casting prepared is composed of duplex grain group of nano grains and micro grains.

2. The metal material prepared by the invention has superior comprehensive properties, such as both high strength and high plasticity. Taking Al-7 wt % Si alloy as an example, parameters of two sets of six-axis motion system are fixed: X=0 mm, Y=0 mm, Z=0 mm, T=0°, M=0 mm, and two rotating tables are used for R rotary motion. As a result, the casting Al—Si alloy block with micro-nano grain structure is prepared through doing composite motions of two sets of rotating motion. Compared with the traditional Al—Si alloy, the matrix of the Al-7 wt % Si alloy prepared by the method has the tensile strength increased by more than 70% and the elongation increased by more than 3 times.

3. Strong applicability. The metal grain size prepared by this method is reduced from micron level to submicron level or nanometer level, and the potential energy changes brittle materials into ductile materials, which improves the strength and toughness of metal materials, polymer materials and inorganic non-metallic materials.

DESCRIPTION OF THE DRAWINGS

The above and further advantages of the invention may be better understood by referring to the following description with the accompanying drawings, in which:

FIG. 1 is a schematic diagram of composition of the composite motion equipment in accordance with one embodiment of the present invention; wherein,

1—cabin system, 2—smelting system, 3—pouring system, 4—casting mold, 5—rotating plate, 6—coupling shaft I, 7—coupling shall II, 8—intermediate coupling seat, 9—coupling shall III, 10—coupling shaft IV, 11—bottom support seat, 12—six-axis motion system I, 13—six-axis motion system II, 14-centrifugal barrel.

Figure 2:
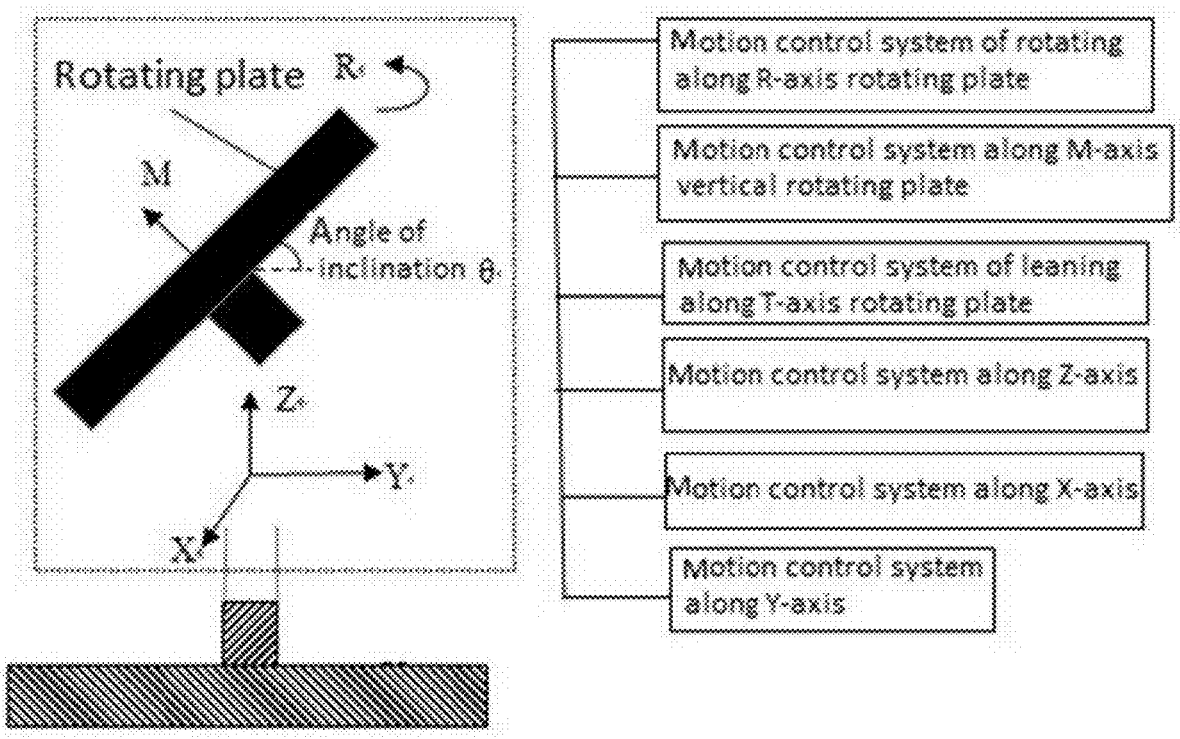

FIG. 2 is a motion schematic diagram of a single six-axis motion system in accordance with one embodiment of the present invention; wherein the distance between two sets of six-axis motion system and system connecting shaft bracket is a.

Figure 3:
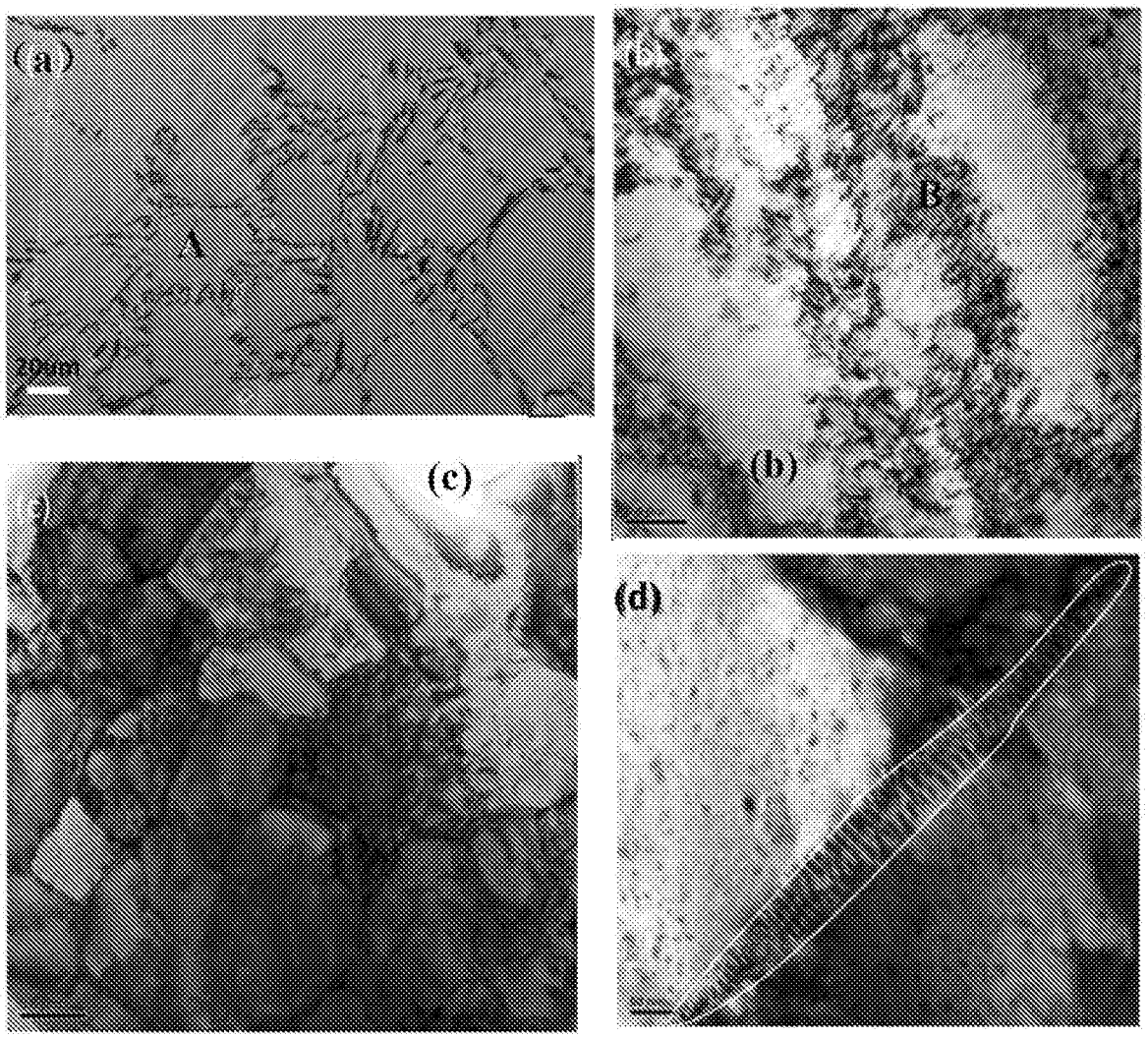

FIG. 3 is morphologies of a low magnification SEM morphology and high magnification TEM morphologies of the cross section of Al-7 wt % Si alloy; wherein, (a) is a SEM morphology of the cross section of Al-7 wt % Si alloy processed by composite shear motion in which the alloy is composed of white aluminum matrix phase and black silicon phase. (b) is a TEM morphology of one amplified region of the white aluminum matrix phase at the point of position A in figure (a), wherein the α-Al matrix is composed of white large aluminum grains (grain sizes from several hundred nm to several μm) and the black grain boundary region surrounding thereof; (c) is a TEM morphology of another amplified region of the white aluminum matrix phase at the point of position A in figure (a), wherein the size of the α-Al matrix is about several hundred nm; (d) is the morphologies of the Si particles distributed in small size aluminum grains in figure (c) and the eutectic structure between two small size aluminum grains in figure (c), which is represented by a dotted line and the spacing of which is about 12 nm.

Figure 4:
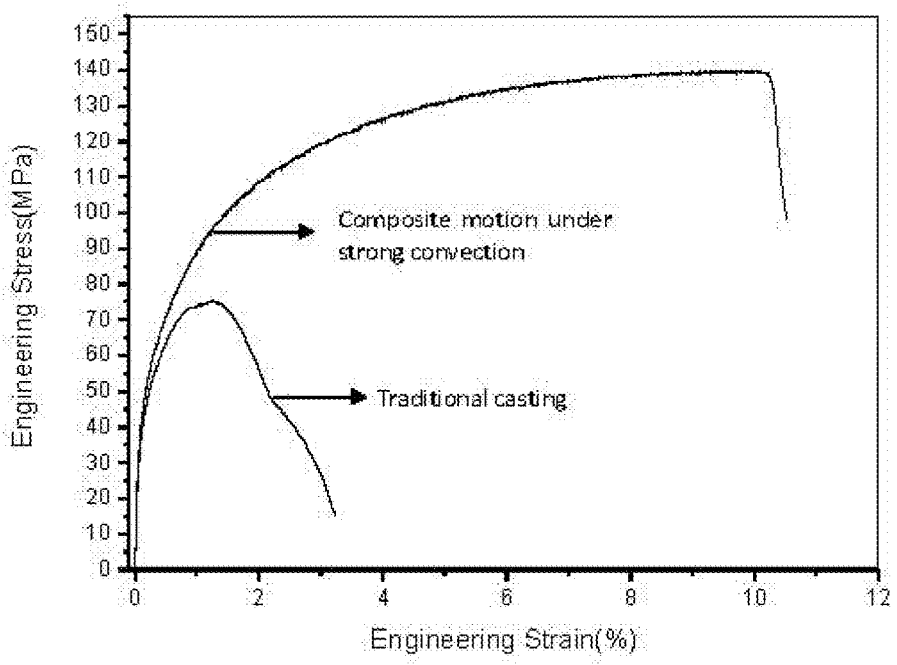

FIG. 4 is a comparison-curve graph of stress and strain in tensile engineering of Al-7 wt % Si alloys prepared respectively via casting under strong convection and conventional casting. The tensile strength is increased by more than 70% and the elongation is increased by more than three times.

Figure 5:
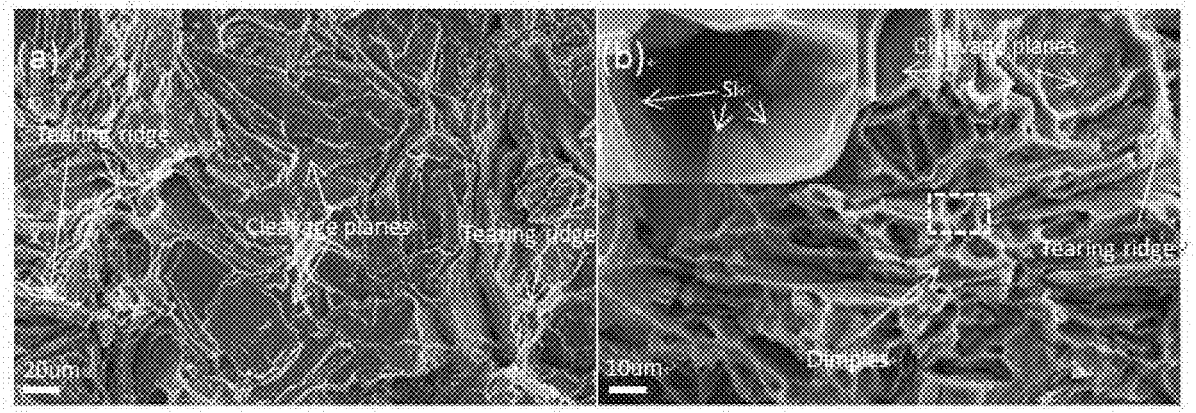

FIG. 5 is comparison SEM morphologies of fracture of Al-7 wt % Si alloys prepared respectively via casting under strong convection and conventional casting. (a) shows the cleavage fracture of the Al-7 wt % Si alloy by the traditional casting and it can be seen that the tearing edges separate large pieces of cleavage surface; (b) shows the decrease of cleavage surface of Al-7 wt % Si alloy prepared by casting under strong convection and dimples appear at the tensile fracture.

DETAILED DESCRIPTION OF PREFERRED EMBODIMENTS

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Embodiment 1

Figure 1:
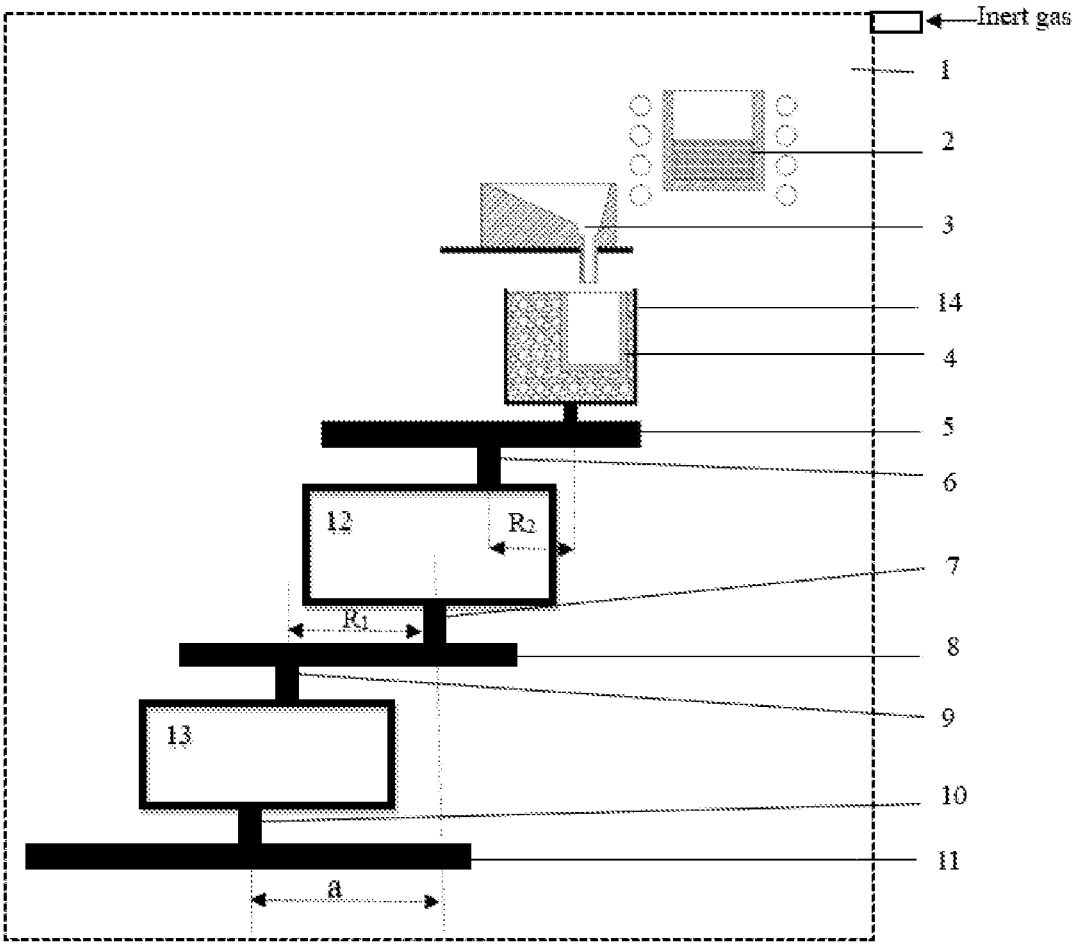

Taking Al-7 wt % Si alloy as an example, nano-micro mixed grains are obtained after metal solidification. Industrial pure aluminum with the pure of 99.8% and industrial pure silicon with the pure of 99.9% are put into one graphite crucible as shown in FIG. 1, and then the materials in the graphite crucible are melting by a medium frequency induction furnace with the condition of vacuum degree of $6.0\times10^{-2}$ Pa in furnace chamber, filling the gas of high purity Ar and the pressure of furnace chamber of 0.04 MPa. The metal in the graphite crucible are heated rapidly until the temperature reaches 1000° C. that should be kept for 1 hour, and then cooled to 750° C. and poured into a rectangle graphite casting mold with internal size of 70 mm×80 mm×110 mm and the thickness of 10 mm which is preheated to 250° C., making sure that the degree of superheat to maintain between 50° C. to 100° C. during the whole casting process while the degree of supercooling of the metal could be between 0.1° C. to 50° C. during the process of solidification. The casting mold should be sealed by a cover in order to prevent metal liquid from spilling as a preference.

The parameters of the equipment in FIG. 1 and FIG. 2 are settled as follows: X=0 mm, Y=0 mm, Z=0 mm, T=0°, M=0 mm. In six-axis motion system II (13), the R parameter is not fixed but continuous, which is corresponding to the radius of the disk of $R_1$=150 mm and the rotation speed of the disk of $n_1$=75 rpm; in the six-axis motion system I (12), the R parameter is also not fixed but continuous, which is corresponding to the radius of the disk of $R_2$=100 mm and the rotation speed of the disk of $n_2$=450 rpm. The alloy liquid is treated by the strong convection in 15 minutes after poured into the casting mold and then removed after it is cooled. FIG. 3, FIG. 4 and FIG. 5 show the morphologies of low-power scanning and high-power transmission of the cross section, a curve graph of stress and strain in tensile engineering and morphology of stretched fracture of Al-7 wt % Si alloy prepared via casting under strong convection. It can be seen that the casting Al-7 wt % Si alloy is compositing of nano-micro duplex grain group.

Embodiment 2

Taking Al-7 wt % Si alloy as an example, nano-micro mixed grains are obtained after metal solidification. Industrial pure aluminum with the pure of 99.8% and industrial pure silicon with the pure of 99.9% are put into one graphite crucible as shown in FIG. 1, and then the materials in the graphite crucible are melting by a medium frequency induction furnace with the condition of vacuum degree of $6.0\times10^{-2}$ Pa in furnace chamber, filling the gas of high purity Ar and the pressure of furnace chamber of 0.04 Mpa. The metal in the graphite crucible are heated rapidly until the temperature reaches 1000° C. that should be kept for 1 hour, and then cooled to 750° C. and poured into a rectangle graphite casting mold with internal size of 70 mm×80 mm×110 mm and the thickness of 10 mm which is preheated to 250° C., making sure that the degree of superheat to maintain between 50° C. to 100° C. during the whole casting process while the degree of supercooling of the metal could be between 0.1° C. to 50° C. during the process of solidification. The casting mold should be sealed by a cover in order to prevent metal liquid from spilling as a preference.

In six-axis motion system II (13), the R parameter is not fixed but continuous, which is corresponding to the radius of the disk of $R_1$=150 mm and the rotation speed of the disk of $n_1$=100 rpm; in the six-axis motion system I (12), the R parameter is also not fixed but continuous, which is corresponding to the radius of the disk of $R_2$=100 mm and the rotation speed of the disk of $n_2$=100 rpm. The alloy liquid is treated by the strong convection in 15 minutes after poured into the casting mold and then removed after it is cooled.

Embodiment 3

Taking Al-7 wt % Si alloy as an example, nano-micro mixed grains are obtained after metal solidification. Industrial pure aluminum with the pure of 99.8% and industrial pure silicon with the pure of 99.9% are put into one graphite crucible as shown in FIG. 1, and then the materials in the graphite crucible are melting by a medium frequency induction furnace with the condition of vacuum degree of $6.0\times10^{-2}$ Pa in furnace chamber, filling the gas of high purity Ar and the pressure of furnace chamber of 0.04 Mpa. The metal in the graphite crucible are heated rapidly until the temperature reaches 1000° C. that should be kept for 1 hour, and then cooled to 750° C. and poured into a rectangle graphite casting mold with internal size of 70 mm×80 mm×110 mm and the thickness of 10 mm which is preheated to 250° C., making sure that the degree of superheat to maintain between 50° C. to 100° C. during the whole casting process while the degree of supercooling of the metal could be between 0.1° C. to 50° C. during the process of solidification. The casting mold should be sealed by a cover in order to prevent metal liquid from spilling as a preference.

In six-axis motion system II (13), the R parameter is not fixed but continuous, which is corresponding to the radius of the disk of $R_1$=150 mm and the rotation speed of the disk of $n_1$=100 rpm; in the six-axis motion system I (12), the R parameter is also not fixed but continuous, which is corresponding to the radius of the disk of $R_2$=100 mm and the rotation speed of the disk of $n_2$=500 rpm. The alloy liquid is treated by the strong convection in 15 minutes after poured into the casting mold and then removed after it is cooled.

We claim:

1. An apparatus for casting materials with nano-micro duplex grain group, said apparatus comprising:

a cabin system, a smelting system, a pouring system, a casting mold, a rotating plate, a coupling shaft I, a coupling shaft II, an intermediate coupling seat, a coupling shaft III, a coupling shaft IV, a bottom support seat, a six-axis motion system I, a six-axis motion system II, and a centrifugal barrel; wherein the casting mold is located in the centrifugal barrel; the centrifugal barrel is linked with the six-axis motion system I via the rotating plate and the coupling shaft I; the six-axis motion system I is linked with the six-axis motion system II via the coupling shaft II, the intermediate coupling seat and the coupling shaft III; the six-axis motion system II is fixed on the bottom support seat via the coupling shaft IV; the rotating plate moves respectively along six axes, that are vertical motions along three kinds of directions including x-axis, y-axis and z-axis, rotating motion R of the rotating plate, vertical motion M perpendicular to the direction of the rotating plate, and inclinable motion T of the rotating plate; wherein θ represents inclinable angle of the rotating plate.

2. The apparatus according to claim 1, wherein the rotating plate rotates along the path whose parameters are in the following limitation: R=−180°-+180°, X==−2500 mm-+2500 mm, Y=−2500 mm-+2500 mm, Z=0-1000 mm, T=−80°-+80°, M=0 mm-1000 mm.

3. The apparatus according to claim 1, wherein the distance of the six-axis motion system I is R1=0-3000 and the distance of the six-axis motion system II is R2=0-3000 mm.

4. A method for casting materials with nano-micro duplex grain group prepared by the apparatus of claim 1, the method comprising:

(1) preparing metal or alloy;

(2) putting the metal or alloy into a crucible of the smelting system; placing the casting mold in the centrifugal barrel; filling refractory insulation material around the casting mold;

(3) heating the metal or alloy in the crucible to a default temperature and keeping the temperature for a default time, and then pouring metal liquid into a preheated casting mold; and (4) driving the six-axis motion systems to force the centrifugal barrel to move according to a set path, and then cooling the metal liquid down.

5. The method according to claim 4, wherein during the process of pouring metal liquid into the preheated casting mold, a superheat degree is controlled according to components of the metal, and during a process of cooling the metal liquid down, a condenser depression is controlled according to components of the metal; strong composite shear flow is formed in the metal liquid with motion of the casting mold that is put into the six-axis motion systems.

6. The method according to claim 4, wherein an applicable material of the metal is nickel, aluminum, iron, copper and titanium, or alloy of the nickel, aluminum, iron, copper and titanium thereof, or intermetallic compound of titanium aluminum, intermetallic compound of iron aluminum, intermetallic compound of nickel aluminum.

7. The method according to claim 4, wherein the processes of melting and casting are carried out in vacuum or non-vacuum.

8. The method according to claim 4, wherein a number of second-phase nano-silicon particles are distributed in an aluminum matrix phase and the sizes of nano-silicon particles are between 1 nm to 100 nm.

* * * * *